United States Patent [19]

Baruffa et al.

[11] 3,990,373

[45] Nov. 9, 1976

[54] MECHANISM FOR THE AUTOMATIC MODULATION OF THE DIRECTION AND AMPLITUDE OF MOVEMENTS OF A MEMBER FOR FEEDING PIECES TO BE SEWN IN A SEWING MACHINE

[75] Inventors: Olindo Baruffa; Norbert Raboud, both of Geneva, Switzerland

[73] Assignee: Mefina S.A., Fribourg, Switzerland

[22] Filed: Oct. 15, 1975

[21] Appl. No.: 622,642

[30] Foreign Application Priority Data

Oct. 23, 1974 Switzerland ..... 14149/74

[52] U.S. Cl. ..... 112/210

[51] Int. Cl.[2] ..... D05B 27/00

[58] Field of Search ..... 112/210, 211, 209, 203, 112/204, 205, 218 R

[56] References Cited

UNITED STATES PATENTS

| | | | |
|---|---|---|---|
| 809,945 | 1/1906 | Hemleb | 112/210 |
| 2,647,481 | 8/1953 | Court | 112/210 |
| 2,808,793 | 10/1957 | Ayres | 112/209 X |
| 2,818,039 | 12/1957 | Ayres | 112/203 X |
| 2,868,150 | 1/1959 | Moro | 112/210 |

*Primary Examiner*—H. Hampton Hunter

*Attorney, Agent, or Firm*—Emory L. Groff, Jr.

[57] ABSTRACT

A mechanism for controlling the direction and amplitude of a cloth feeder in a sewing machine comprises a cam keyed on a spindle having a control button, said cam acting on an actuating arm of a control shaft of which the angular position determines the direction and amplitude of the feeder. By turning the control button, the cam angularly sets the actuating arm and hence the stitch length. When the button is turned to a given angular position, a cam profile thereon axially displaces a sliding rod to push a sliding pinion and bring a cam profile of the pinion into contact with an eccentric protuberance of the cam. The pinion is driven by the main shaft of the machine so that in said given position of the button it axially reciprocates the cam and hence automatically modulates the direction and amplitude of the cloth feeder to execute a special stitch.

4 Claims, 5 Drawing Figures

FIG. 1
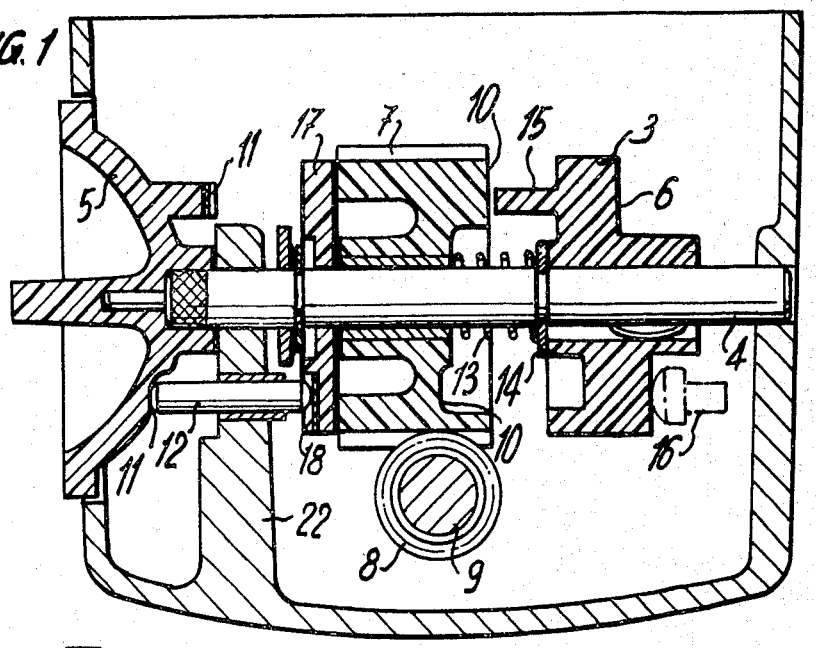
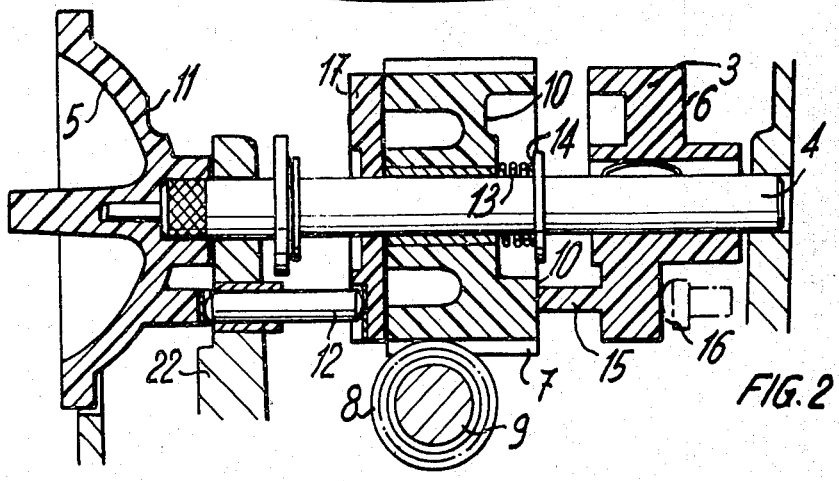
FIG. 2
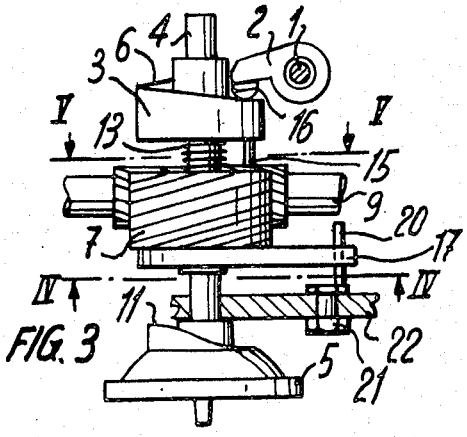
FIG. 3
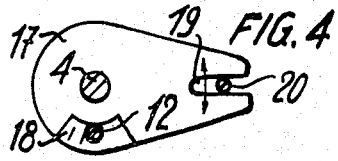
FIG. 4
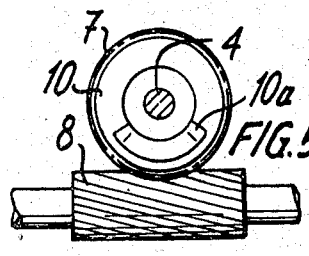
FIG. 5

MECHANISM FOR THE AUTOMATIC MODULATION OF THE DIRECTION AND AMPLITUDE OF MOVEMENTS OF A MEMBER FOR FEEDING PIECES TO BE SEWN IN A SEWING MACHINE

The invention relates to sewing machines.

Many simple sewing machines are provided with means for manually regulating the direction and amplitude of movements of the device for feeding pieces to be sewn under the needle.

To sew certain utilitarian or decorative stitches, after a given number of stitches the direction of feed or the length of the stitches must be modified.

For example, to provide a so-called triple stitch, two stitches are made forwards, then one stitch backwards, two more stitches forwards, then one stitch backwards, and so on.

To do this, use is generally made of a machine having an automatic control of the direction of feed by means of a cam rotatably driven by the main shaft of the machine. Such known machines are of complex construction and consequently very expensive.

An aim of the invention is to provide a simple sewing machine at low cost with a mechanism for the automatic modulation of the direction and amplitude of movement of the cloth feeding device to enable at least one utilitarian or decorative stitch to be made.

The invention concerns a mechanism for the automatic modulation of the direction and amplitude of movement of a device for feeding pieces to be sewn in a sewing machine, which device includes a control shaft able to occupy several angular positions determining the direction and amplitude of movements of the feed, said mechanism comprising a cam keyed for axial sliding movement on a spindle having a manually-actuable control button, said cam being in contact with an actuating arm of said control shaft to determine the angular position thereof, a pinion mounted freely on said spindle between said cam and the control button, a driving shaft of the machine operatively connected to the pinion to rotate it about said spindle, the pinion being axially moveable towards said cam against the action of a spring by a sliding rod axially biased towards the pinion by a cam profile on said control button when said control button is in a given angular position, the pinion having on its face facing said cam a cam profile which when said control button is in said given angular position operatively contacts an eccentric protuberance of said cam to axially reciprocate said cam and angularly move said actuating arm of said control shaft in response to rotation of the pinion.

The accompanying drawings show schematically and by way of example an embodiment of the mechanism according to the invention. In the drawings:

FIG. 1 is a transverse cross-section of the upper arm of a sewing machine showing the mechanism in a manual regulating position;

FIG. 2 is a view similar to FIG. 1 showing the mechanism in an automatic modulating position;

FIG. 3 is a top plan view of the mechanism in the manual regulating position;

FIG. 4 is a cross-section along line IV—IV of FIG. 3; and

FIG. 5 is a cross-section along line V—V of FIG. 3.

The mechanism shown in the drawings is specifically intended for a sewing machine in which the feeder, in the form of a serrated claw, for feeding pieces to be sewn is animated by a motor driving the entire mechanism of the machine and in which the amplitude and direction of movement of this feeder are controlled by the intermediary of a vertical shaft 1 as described, for example, in U.S. Pat. No. 2,647,481.

Only the mechanism for giving the various positions to the vertical shaft 1 has been shown in the drawings, since the remainder of the mechanism for controlling the amplitude and direction of movement of said feeder is known.

The shaft 1 is axially fixed and guided in bearings in the column of the machine. It is provided at its upper part with an actuating arm 2 and is normally biased by a spring in the counter-clockwise direction, looking at FIG. 3.

The mechanism for manually regulating the direction and amplitude of movement of said feeder comprises a cam 3 keyed on a spindle 4 mounted in the upper arm of the machine at right angles to shaft 1 and provided at its end with a control button 5. The cam 3 is adapted to act by its profile 6 on a following finger 16 carried by arm 2 of shaft 1, against the action of the biasing spring of the latter. A manual regulation of the direction and amplitude of movement of said feeder can thus be provided by rotation of button 5.

A toothed pinion 7 mounted freely on spindle 4 between cam 3 and button 5 is rotatably driven by a worm 8 carried by the driving shaft 9 of the machine. On its face facing cam 3, pinion 7 has a cam profile 10.

The button 5 has on its face facing pinion 7 a cam profile 11 enabling the pinion 7 to be axially moved in the direction of cam 3 by the intermediary of a rod 12 axially slidably mounted in the upper arm of the machine parallel to spindle 4. A biasing spring 13 surrounding spindle 4 is disposed between pinion 7 and a ring 14 axially fixed on spindle 4, this ring simultaneously serving as a stop limiting movement of cam 3 to the left, looking at FIGS. 1 and 2. Cam 3, which is slidably mounted on spindle 4, has on its face facing pinion 7 an eccentric protuberance 15 on which the cam profile 10 of pinion 7 acts when pinion 7 is axially moved by rod 12 towards cam 3 (FIG. 2).

In order to distribute the action of rod 12 over the entire face of pinion 7 facing button 5, between the pinion 7 and rod 12 is inserted an oblong bearing piece 17 freely mounted on spindle 4. Bearing piece 17 has on its face facing rod 12 an inclined ramp 18 cooperating with the end of rod 12 opposite that urged by cam profile 11 of button 5. Piece 17 also has a notch 19 in which is engaged a pin 20 forming an eccentric extension of the threaded shank of a bolt 21 screwed in a support 22 of the upper arm of the machine.

The cam profile 10 of pinion 7 comprises, over a circular arc of 120°, a recessed part **10*a* having a depth enabling communication to arm 2 of the oscillation required to pass from sewing in a forward direction to sewing in the reverse direction with the same stitch length. The reduction ratio of the drive of pinion 7 by the intermediary of the driving shaft 9 of the machine corresponds to one complete turn of pinion 7 for three turns of shaft 9**.

Hence, when pinion 7 is brought into the position of FIG. 2, hereinafter referred to as the position with automatic modulation of the stitch length, and is rotated by the driving shaft 9, it communicates to the cam 3 an axial reciprocating movement causing an angular displacement of the arm 2 actuating the shaft 1 controlling said feeder corresponding to triple sewing, namely two forward stitches followed by one reverse stitch of the same length.

To set the machine for automatic modulation of the stitch length, it suffices to turn button 5 beyond the position corresponding to the maximum stitch length with reverse feed.

To adjust the stitch lengths for reverse and forward feed so as to make them equivalent, during automatic triple sewing, it is possible to provide a fine regulation of the axial position of pinion 7 on spindle 4, when button 5 is in the position with automatic modulation of the stitch length. To do this, it suffices to adjust the position of the end of rod 12 in contact with ramp 18 by rotating the bearing piece 17 in either direction about spindle 4. This fine regulation is generally carried out during assembly of the machine by turning bolt 21 in either direction before tightening it on support 22. By doing this, the position of the eccentric pin 20 is adjusted and this in turn determines the angular setting of piece 17 and hence the position of its ramp 18 in contact with rod 12.

Of course, it would be possible to provide for adjustment of the lengths of forward and reverse feed, by the user of the machine, when the button 5 is positioned to automatically modulate the stitch length, by replacing the bolt 21 by a manually-controlled spindle.

In the case of a zig-zag sewing machine, to provide automatic triple sewing in a straight-line one should of course simultaneously set the zig-zag control to the position of zero oscillation of the pivoting cradle of the needle bar. In addition, when the machine is set for zig-zag sewing, a decorative stitch can be provided by simultaneously automatically actuating the cam 3 by pinion 7.

We claim:

1. A mechanism for the automatic modulation of the direction and amplitude of movement of a device for feeding pieces to be sewn in a sewing machine, which device includes a control shaft able to occupy several angular positions determining the direction and amplitude of movements of the feed, said mechanism comprising a cam keyed for axial sliding movement on a spindle having a manually-actuable control button, said cam being in contact with an actuating arm of said control shaft to determine the angular position thereof, a pinion mounted freely on said spindle between said cam and the control button, a driving shaft of the machine operatively connected to the pinion to rotate it about said spindle, the pinion being axially moveable towards said cam against the action of a spring by a sliding rod axially biased towards the pinion by a cam profile on said control button when said control button is in a given angular position, the pinion having on its face facing said cam a cam profile which when said control button is in said given angular position operatively contacts an eccentric protuberance of said cam to axially reciprocate said cam and angularly move said actuating arm of said control shaft in response to rotation of the pinion.

2. A mechanism according to claim 1, in which said cam profile of the pinion comprises a recessed part extending over an arc of 120°.

3. A mechanism according to claim 2, in which the reduction ratio of the pinion in relation to said driving shaft of the machine is one turn of the pinion for three turns of said driving shaft.

4. A mechanism according to claim 1, comprising a bearing piece interposed between the pinion and said rod, said bearing piece being mounted freely on said spindle and having on its face facing said rod a ramp cooperating with an end of said rod opposite that which is urged by said cam profile of the control button, and means for angularly setting said bearing piece about said spindle to adjust the position of said end of said rod on said ramp.

* * * * *